US006182880B1

(12) United States Patent
Dotey

(10) Patent No.: US 6,182,880 B1
(45) Date of Patent: Feb. 6, 2001

(54) FEEDING DEVICE FOR STRIPS

(75) Inventor: Robert L. Dotey, Wilmington, DE (US)

(73) Assignee: Herrblitz Modular System S.r.l., Turin (IT)

( * ) Notice: Under 35 U.S.C. 154(b), the term of this patent shall be extended for 0 days.

(21) Appl. No.: 09/414,642

(22) Filed: Oct. 8, 1999

(51) Int. Cl.[7] ..... B65H 20/00; B65H 23/06
(52) U.S. Cl. ..... 226/141; 226/150
(58) Field of Search ..... 226/128, 132, 226/133, 141, 150

(56) References Cited

U.S. PATENT DOCUMENTS 2,624,575 * 1/1953 Koch ..... 226/141
2,670,953 * 3/1954 Marsilius ..... 226/141
4,513,899 * 4/1985 Ledgerwood ..... 226/141
4,580,710 * 4/1986 Ledgerwood ..... 226/141
5,505,360 * 4/1996 Giusto ..... 226/150
5,513,790 * 5/1996 Giusto ..... 226/150

* cited by examiner

*Primary Examiner*—Michael R. Mansen
(74) *Attorney, Agent, or Firm*—Sughrue, Mion, Zinn, Macpeak & Seas, PLLC

(57) ABSTRACT

A feeding device for strips including a stationary gripper (3) and a movable gripper (4) that is linearly movable with an alternating motion with respect to the stationary gripper (3) along longitudinal sliding guides (1). The feeding step of the strip is determined by the position of a stop crosspiece (8) provided with a pair of end blocks (13) having respective substantially hemispherical protrusions (18) suitable for engaging with a positive coupling in corresponding substantially hemispherical recesses (19) in the longitudinal sliding guides (1).

4 Claims, 2 Drawing Sheets

FEEDING DEVICE FOR STRIPS

BACKGROUND OF THE INVENTION

This invention relates in general to strip feeding devices.

More particularly, the invention concerns a feeding device of the type comprising a pair of longitudinal sliding guides, means for feeding the strip in steps parallel to said guides, including a stationary gripper and a movable gripper each comprising a fixed jaw and a movable jaw arranged transversally and on opposite sides of the strip and a pneumatic actuator group for commanding the linear alternating movement forward and backward of the movable gripper with respect to the stationary gripper along said longitudinal guides and the opening and closing movements of the movable jaws of the said grippers with respect to the respective fixed jaws in sync with the alternating movement of the movable gripper, and an adjustable abutment member interacting with the movable gripper at the end of its forward movement in order to determine the strip feeding step.

PRIOR ART

Feeding devices of this type are known from the European patents EP-B-655405 and EP-B-655406 wherein the abovementioned abutment member comprises a crosspiece provided with a pair of end blocks suitable for engaging, by way of removable positive couplings, with corresponding reference seats of the sliding guides of the feeder.

This embodiment is illustrated schematically in FIG. 1, wherein with the numeral 1 are indicated the two longitudinal sliding guides at one end of which is fitted a pneumatic actuator unit 2 with which the stationary gripper 3, with its fixed 3*a* and movable 3*b* jaws, is operatively associated. Indicated with the numeral 4 is the movable gripper, with its fixed 4*a* and movable 4*b* jaws, which is movable with an alternating rectilinear motion along the sliding guides 1 by means of the rod 5 of the pneumatic actuator unit 2.

The movable jaws 3*b* and 4*b* of the stationary 3 and movable 4 grippers are made from crosspieces arranged orthogonally to the feeding direction of the strip, parallel to the sliding guides 1 and indicated with F, and actuated—in sync with the alternating movement of the movable gripper 4—between a raised position and a lowered strip gripping position.

The movable gripper 4, at the end opposite the stationary gripper 3, bears a central damping abutment 6 suitable for interacting with an adjustable screw-in stop 7 borne by a crosspiece 8 adjustably fastened to the sliding guides 1. The adjustment position of the crosspiece 8, and therefore the adjustment of the relative screw-in stop 7, permit to determine with precision the stroke of the movable gripper 4 and, as a result, the strip feeding step.

For adjustment purposes, the stop crosspiece 8 is traditionally provided with a pair of end blocks 9 each removably attached thereto by a respective pair of lateral screws 10. Each end block 9 is made integrally with an internal prismatic key-shaped protrusion 11 suitable for selectively engaging, through a removable positive coupling, with complementary prismatic key seats 12 made in the external side of the corresponding sliding guide 1.

The production of the prismatic key seats 12 involves relatively complex and delicate milling operations, followed by manual rectification. These are obviously onerous operations, leading to high production costs.

SUMMARY OF THE INVENTION

The object of this invention is that of overcoming the above drawback.

In accordance with the invention, this object is achieved due to the fact that the abovementioned reference seats of the longitudinal sliding guides are made from substantially hemispherical recesses, and that said end blocks of the stop crosspiece are provided with substantially hemispherical protrusions suitable for engaging in said recesses.

Production of the hemispherical recesses, using simple, complementarily shaped milling tools, does not present any particular difficulties and does not require any further finishing work. The hemispherical protrusions of the end blocks of the crosspiece are also particularly simple to produce, given that these protrusions may to advantage be made of end heads borne on pins inserted in corresponding holes in the blocks themselves.

DETAILED DESCRIPTION OF THE INVENTION

Figure 1:
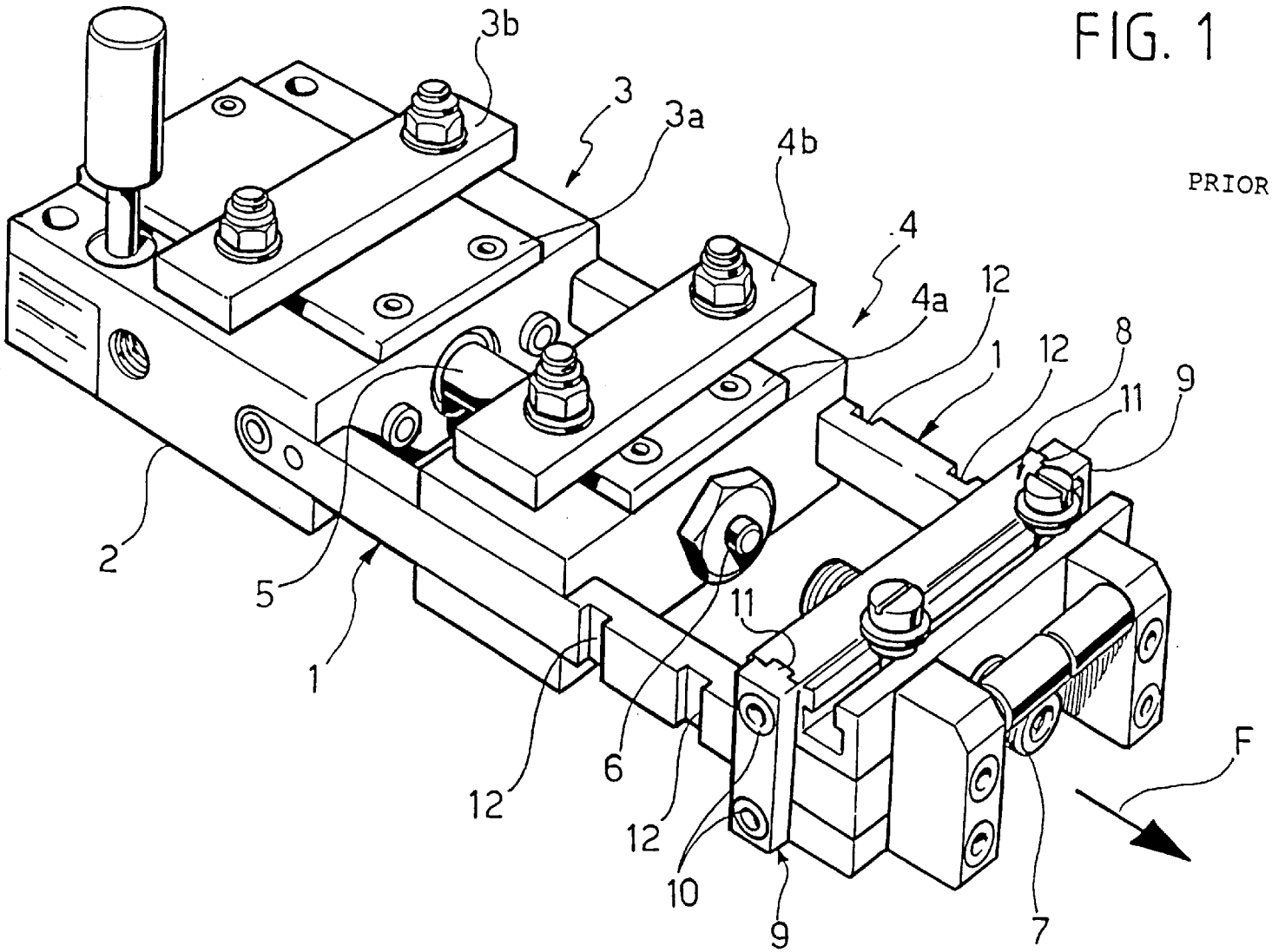
FIG. 1 PRIOR ART
FIG. 1 is an overall schematic perspective view depicting a strip feeding device (already described in the foregoing) according to the prior art.
Figure 3:
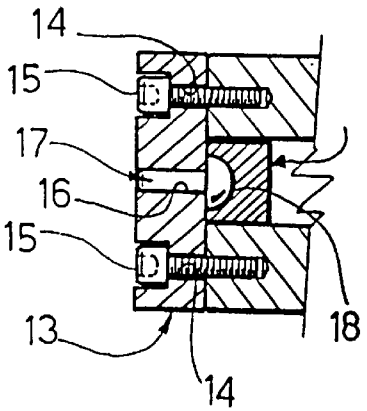
FIG. 3 is a view in partial transversal section according to the line III—III in FIG. 2.
Figure 2:
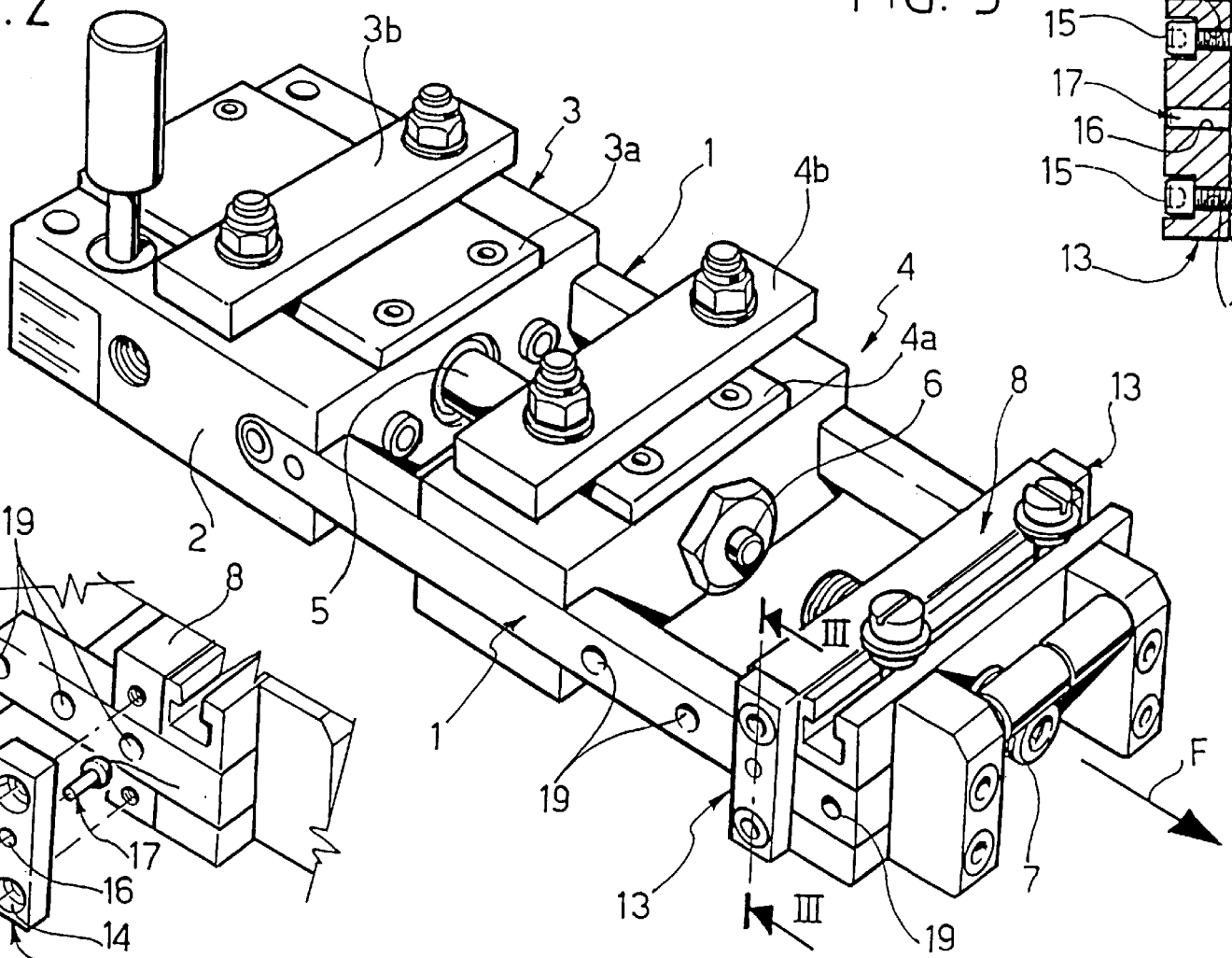
FIG. 2 is a similar view to FIG. 1 depicting a strip feeding device according to this invention.
Figure 4:
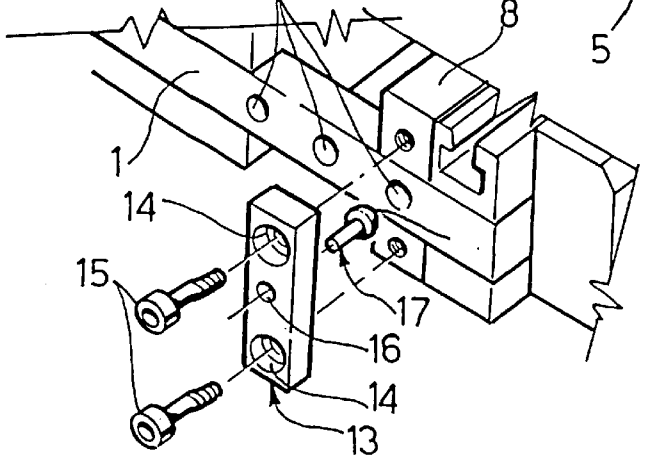
FIG. 4 is an exploded perspective view of FIG. 3.

The feeding device according to this invention represented as a whole in FIG. 2 is generically similar to the known one already described above with reference to FIG. 1, so that parts identical or similar to those already described are indicated with the same reference numerals. Unlike the prior art, in the feeding device according to this invention the stop crosspiece 8 is provided with end blocks 13 of a simple parallelepipedal shape, i.e. not made with the prismatic keys 11 of the feeder described above in accordance with the known art. Each end block 13 has, instead, in an intermediate position between the holes 14 in which the two screws 15 for fastening to the crosspiece 8 are inserted, a further through hole 16 in which a pin 17 is force fitted, i.e. embedded. The pin 17 has, on the inner side of the stop block 13, a hemispherical, enlarged end head 18.

In place of the prismatic milled parts 12, the outer sides of the sliding guides 1 of the feeding device according to the invention are made with substantially hemispherical recesses 19 of a shape complementary to that of the heads 18 of the pins 17. These hemispherical seats 19 are provided at preestablished intervals substantially at the longitudinal centre line of the respective sliding guides 11.

It will be obvious that, in order to position the stop crosspiece 8 in the preestablished position, it is sufficient to slacken the screws 15 of the two end blocks 13, to insert the hemispherical heads 18 of the relative pins 17 in the preselected hemispherical seats 19 and then to lock the screws 15 again to block the stop crosspiece 8 to the sliding guides 1 in the preselected position.

Naturally the construction details and the embodiments may be altered considerably with respect to those described and illustrated, without departing from the scope of the present invention, as defined in the claims that follow.

What is claimed is:

1. Strips feeding device comprising a pair of longitudinal sliding guides (1), means for feeding of the strip in steps parallel to said sliding guides (1) including a stationary gripper (3) and a movable gripper (4) each comprising a fixed jaw (3*a,* 4*a*) and a movable jaw (3*b,* 4*b*) arranged transversally and on opposite sides of the strip and a pneumatic actuator group (2) for commanding the linear alternating movement forward and backward of the movable gripper (4) with respect to the stationary gripper (3) along said longitudinal guides (1) and the opening and closing movements of the movable jaws (3*b,* 4*b*) of said grippers (3, 4) with respect to the respective fixed jaws (3*a,* 4*a*) in sync with the alternating movement of the movable gripper (4), and an adjustable abutment member (8) interacting with the movable gripper (4) at the end of its forward movement in order to determine the strip feeding step, wherein said abutment member (8) comprises a crosspiece provided with a pair of end blocks (13) to be engaged, by way of removable positive couplings, with corresponding reference seats (19) of said sliding guides (1), and said reference seats are made from substantially hemispherical recesses (19) and said end blocks (13) of the stop crosspiece (8) are provided with substantially hemispherical protrusions (18) for engaging in said recesses (19).

2. Feeding device according to claim 1, wherein said substantially hemispherical protrusions (18) are made of end heads borne on pins (17) inserted in corresponding holes (16) in said end blocks (13) of the stop crosspiece (8).

3. Feeding device according to claim 2, wherein said pins (17) are force fitted into the corresponding holes (16) in said end blocks (13) of the stop crosspiece (8).

4. Feeding device according to claim 2, wherein said substantially hemispherical recesses (19) are arranged substantially at the centre line of said longitudinal sliding guides (1).

* * * * *